US008904710B2

(12) United States Patent
Römer et al.

(10) Patent No.: US 8,904,710 B2
(45) Date of Patent: Dec. 9, 2014

(54) DOOR DRIVE

(75) Inventors: Martin Römer, Breckerfeld (DE); Michael Hufen, Wuppertal (DE); Alexander Hellwig, Ennepetal (DE); Holger Hänsch, Witten (DE)

(73) Assignee: Dorma GmbH + Co. KG, Ennepetal (DE)

( * ) Notice: Subject to any disclaimer, the term of this patent is extended or adjusted under 35 U.S.C. 154(b) by 588 days.

(21) Appl. No.: 12/742,822

(22) PCT Filed: Nov. 13, 2008

(86) PCT No.: PCT/EP2008/009647

§ 371 (c)(1),
(2), (4) Date: May 13, 2010

(87) PCT Pub. No.: WO2009/062729

PCT Pub. Date: May 22, 2009

(65) Prior Publication Data

US 2010/0281777 A1 Nov. 11, 2010

(30) Foreign Application Priority Data

Nov. 13, 2007 (DE) ..... 10 2007 054 460

(51) Int. Cl.
*E05F 11/24* (2006.01)

(52) U.S. Cl.
USPC ..... 49/339; 49/340; 49/324

(58) Field of Classification Search
USPC ..... 49/324, 339, 340
See application file for complete search history.

(56) References Cited

U.S. PATENT DOCUMENTS

| | | | | |
|---|---|---|---|---|
| 3,702,462 | A * | 11/1972 | England | 710/1 |
| 4,040,143 | A | 8/1977 | Lasier et al. | |
| 4,832,617 | A * | 5/1989 | Brown | 439/326 |
| 5,422,436 | A * | 6/1995 | Zachrai | 174/666 |
| 6,177,771 | B1 * | 1/2001 | Kinzer et al. | 318/280 |
| 7,051,561 | B2 * | 5/2006 | Moon et al. | 70/283.1 |
| 2005/0178066 | A1 * | 8/2005 | Drux et al. | 49/340 |
| 2008/0256862 | A1 * | 10/2008 | Hansch et al. | 49/32 |
| 2010/0175326 | A1 * | 7/2010 | Drux | 49/348 |
| 2010/0263284 | A1 * | 10/2010 | Romer et al. | 49/358 |
| 2010/0293856 | A1 * | 11/2010 | Wildforster et al. | 49/324 |

FOREIGN PATENT DOCUMENTS

| | | |
|---|---|---|
| DE | 20 2004 020163 | 5/2006 |
| DE | 10 2005 001314 | 7/2006 |
| DE | 20 2006 017302 | 1/2007 |

* cited by examiner

*Primary Examiner* — Gregory J Strimbu
(74) *Attorney, Agent, or Firm* — Cozen O'Connor

(57) ABSTRACT

A door operator for operating a swing leaf in a door assembly. The door operator is configured to be mounted to a reception body such as a door transom, a wall or the like, and has a connector module for connecting with at least one connecting line. The connector module from a direction of the reception body and from at least one lateral direction, has at least one opening, through which the connecting line can be optionally guided to the connector module.

18 Claims, 8 Drawing Sheets

DOOR DRIVE

PRIORITY CLAIM

This is a U.S. national stage of application No. PCT/EP2008/009647, filed on 13 Nov. 2008, which claims Priority to the following German, Application Nos.: 10 2007 054 460.1, filed: 13 Nov. 2007; 10 2007 054 462.8, filed: 13 Nov. 2007; 10 2007 054 463.6, filed: 13 Nov. 2007; and 10 2007 054 464.4, filed: 13 Nov. 2007; the contents of which are incorporated here by reference.

BACKGROUND OF THE INVENTION

1. Field of the Invention

The present invention relates to a door operator for operating a swing leaf of a door assembly, wherein the door operator is configured to be mounted at a reception body such as a door transom, a wall, or the like, and has a connector module for connecting at least one connecting line.

2. Prior Art

Door operators are known, which are electro-mechanic or electro-hydraulic door operators and require a power supply via at least one external connecting line. Furthermore, external connecting lines may include various signal lines to connect the door operator to a central control, which is provided outside the door operator, for example in a building. Further connecting lines may include the junction link to sensors which are likewise provided outside the door operator at the door assembly. With the intention to reduce the multiplicity of variants of current door operators and to have standardized door operators qualify for more flexible mounting, solutions are necessary to provide door operators which, despite a uniform configuration, allow for most diverse mounting situations.

In particular door operators are in demand, which, in the shipping condition, are structured that a mechanic only needs to perform simple modifications during the installation on-site, to adapt the standardized door operator to the most diverse mounting situations and application possibilities. In this case, particular requirements relate to the configuration of the connector module which represents the interface of the door operator to external devices.

SUMMARY OF THE INVENTION

It is an object of the present invention to provide a door operator which is configured for flexible mounting in various mounting situations.

According to one embodiment of the invention the connector module, from the direction of the reception body and from at least one lateral direction, has at least one opening, through which the connecting lines can be optionally guided to the connector module.

According to one embodiment of the invention the connector module further increases the flexibility with regard to mounting the door operator in various mounting situations. In particular in the case of a wall mounting or when mounting the door operator at the door transom, an electrical connecting line may be already pre-installed such that the connecting line is led out of the wall or out of the door transom at a suitable location. If the connector module has an opening pointing into the direction of the reception body, the connecting line may be guided through this opening in order to constitute the supply connection or signal connection on the inside of the connector module.

However, if a connecting line is run in the direction towards the door operator on the outside on the reception body, the opening in the connector module pointing to the lateral direction is utilized. In particular at first the door operator can be mounted and subsequently the connecting line can be affixed. In this case, the opening in the lateral direction can be utilized. In particular the power supply can be guided through the opening from the direction of the reception body, whereas the connecting lines for the signal supply can be guided through the opening in the lateral direction. This creates a very flexible and variable mounting for a standardized door operator, wherein it is very often possible to decide only on-site during installation which connection type will be utilized to connect the door operator.

Preferably, at least one terminal connector component is accommodated in the connector module to establish an electrical connection for the connecting line. The terminal connector component serves to connect the power supply, wherein the door operator may comprise a mounting plate such that the terminal connector component is mechanically accommodated on the mounting plate. The terminal connector component may have latching projections for its reception on the mounting plate, which latch into insert recesses, which are provided in the mounting plate. For further simplifying the connection between the connecting line and the terminal connector component, the terminal connector component may have unlocking push buttons which can be manually operated. When operating the unlocking push buttons, the connecting line can be inserted into associated connecting terminals. The unlocking push buttons of the terminal connector component may be configured as spring-loaded such that, once the operation of the unlocking push buttons is terminated; the connecting line is firmly received in the terminal connector component.

Preferably, the unlocking push buttons are configured in a way that the connecting lines can be simply inserted into the terminal connector component without having to be operated separately and are retained in the terminal connector component at least in the pull-out direction, which simplifies the connecting procedure.

Furthermore, at least one distributor circuit board, which allows for a variable voltage supply distribution to at least one power supply unit provided in the door operator, may be accommodated in the connector module.

A connecting bridge line may be provided between the connector module and the distributor circuit board. This allows for establishing an electrical connection between the terminal connector component and the distributor circuit board.

The distributor circuit board may comprise a number of connecting sockets into which the associated connecting plugs are insertable. The connecting sockets of the distributor circuit board may comprise a first connecting socket for connecting to the terminal connector component, wherein another connecting socket for connecting to the power supply unit may be provided within the door operator. Furthermore, a third connecting socket for connecting another door operator provided on the distributor circuit board such that, in case of a double-leaf door, only one connecting line can supply two door operators. Furthermore, an ON-OFF switch may be provided on the distributor circuit board in order to manually switch the door operator on and off. For this purpose, the distributor circuit board can be accommodated in the connector module in such a way that at least the ON-OFF switch extends in the direction towards an outside of the connector module.

According to one embodiment of the door operator, the connector module may be positioned on the mounting plate via pilot pins and preferably be self-retainingly accommodated. In this case, the self-retaining reception concerns the reception of the door operator on the mounting plate in an intermediate mounting step. The mechanic may affix the modules of the door operator, comprising the connector module, in a precise position on the mounting plate via the pilot pins. In the following, it is not required to manually hold the door operator on the mounting plate such that the mechanic can effect the final screw connection between the door operator and the mounting plate in a simplified manner. The door operator may consist in particular of individual modules, wherein the connector module is one of the modules forming the door operator.

It is furthermore preferred the connector module be configured such as to protrude beyond the mounting plate in lateral direction. This results in the advantage of creating a free access for the connecting line from the direction of the reception body, i.e. from the direction of the mounting plate, to the terminal connector component. The mounting plate may be configured as a flat oblong sheet metal component, wherein the direction of extension of the sheet metal component corresponds to the longitudinal extension of the door operator. If the mounting plate is correspondingly shorter, it will terminate within the connector module and the terminal connector component can be mounted onto the mounting plate at the end side. For example, if the connecting line penetrates the reception body in the area between the end of the mounting plate and the end of the body of the connector module, establishing the connection between the connecting line and the terminal connector component is particularly simple. The connector module has in particular an inner compartment which offers sufficient storage space for excess cable length.

To create a mechanical reception for the connecting line in the door operator, at least one cable relief may be provided at the connector module. The cable relief may be formed in particular by a clamping element which is inserted into a clamping element reception at the connector module. The clamping element reception forms a type of insert by two lateral rails, into which the clamping element can be inserted. If the connecting line is guided through the clamping element, the latter may be finally screwed to the connector module, whereby the connecting line is simultaneously clamped. A cable relief is thereby created, wherein, when a mechanical tensile load on the connecting line occurs, the clamping element absorbs the force and the electrical connection between the connecting line and the terminal connector component is not under load. The cable relief is mounted at the underside in a vertical direction at the connector module and serves as a cable relief for a connecting line which is guided to the connector module via the lateral direction.

Furthermore, a cable relief element may be provided disposed at the terminal connector component. The cable relief element may have a U-shaped section for being positively inserted into the terminal connector component, which is adjoined by a T- or H-shaped section serving as a clamping lacing to the connecting bridge line and/or the connecting line. The connecting bridge line and/or the connecting line may be tied to the T- or H-shaped section of the cable relief element via a cable tie.

In its geometric configuration, the inventive connector module forms a shell or a basket, which is configured to form cavities and to have thin walls and is manufactured for example in a plastic material injection moulding process, from thermosetting plastic, in a deep-drawing process or in a metal die-casting process, The plastic material configuration has the advantage that the connector module is electrically insulated. In particular a frame to be inserted or to be clipped on the distributor circuit board may be provided at the connector module in a holding manner. In a conceptual form, the shell-like or basket-like shape of the connector module is a cube, which represents an end-side section of the cuboid door operator.

The door operator comprises a signal connecting circuit board, which serves in particular to connect the connecting lines which are required between the door operator and external sensors or an external control for example. The signal connecting circuit board may be clipped at the top side on the connector module by associated latching elements to be received and retained thereon. Advantageously the signal connecting circuit board is configured in a U-shape or horseshoe-shape. The central section, formed by the U-shape or the horseshoe-shape, corresponds to a top side opening within the basket-shaped connector module. If the signal lines are run through the opening from the direction of the reception body or through the opening from the lateral direction into the inner compartment of the connector module, the corresponding connecting lines can be connected to associated connecting terminals fitted on the signal connecting circuit board. As a consequence, the connecting lines can be led to the connecting terminals in a simple manner through the top side opening. The connecting terminals may comprise screw terminals, which are easily accessible for a mechanic, because they point to the top, i.e. from the mounting plate in the direction towards the connector module and consequently, if the connector module is already installed, they are easy to manipulate.

It is furthermore intended the connector module has a support area for supporting the signal connecting circuit board, wherein a partial area of the support area is configured at a support part which is foldably disposed at the connector module. Prior to clipping the signal connecting circuit board on the connector module, the support part may be folded-open, in order to establish the connections to the terminal connector component for example, which are provided on the lower side. Furthermore, the distributor circuit board may be slid in the inserting frame or clipping frame below the support part. If subsequently the support part is folded and latched, such that the partial surface forms one plane with the remaining support surface of the signal connecting circuit board, the inserting frame or clipping frame is closed in such a way that the distributor circuit board is firmly inserted in the connector module.

To further extend the signal links, which are led into the door operator via the connecting terminals on the signal connecting circuit board by the external connecting lines, a flat cable may be provided that leads the signal links towards a control unit within the door operator. In this case, the flat cable can be run above the individual modules forming the door operator. According to an advantageous further development of the connector module, at least one cable guide is located on the top side, in order to establish a predetermined path for the flat cable within the door operator.

In addition to the connector module, the door operator may have a drive module or a main module, which comprises a drive unit. The unit can be mechanically and self-retainingly connected to the connector module via at least one slip-on projection, wherein at least one slip-on recess, which is complementary to the slip-on projection, is provided at the connector module, into which the slip-on projection can be inserted. Furthermore, the connector module may be self-retainingly connected to the drive unit by a latching device which comprises at least one latching projection. As a consequence, at least the connector module can form a mechanical unit with the main module or the drive module, the mechanic is then able to handle this unit individually and to place it onto the mounting plate.

It may be furthermore provided that the drive unit has a shaft passage for a door operator output shaft to pass therethrough. The door operator output shaft may exit the drive unit at a first side and/or a second side of the door operator. The connector module may protrude from the drive unit over the area of the shaft passage, wherein a pocket-shaped recess may be provided in the connector module through which the door operator output shaft passes through the walling of the connector module.

Preferably, a first closure element is provided which can be inserted into the recess such as to form a shaft passage for the door operator output shaft in the connector module. If the door operator output shaft is led out of the door operator at the opposite side, a second closure element may be provided which is insertable into the recess in the connector module and completely closes the latter. As a consequence, the second closure element forms a type of blind plug, whereas the first closure element, together with the pocket-like recess, forms a circular passage.

BRIEF DESCRIPTION OF DRAWINGS

Hereinafter, further measures enhancing the invention will be illustrated in detail in conjunction with the description of a preferred embodiment of the invention based on the Figures, in which.

DETAILED DESCRIPTION OF THE DRAWINGS

Figure 1:
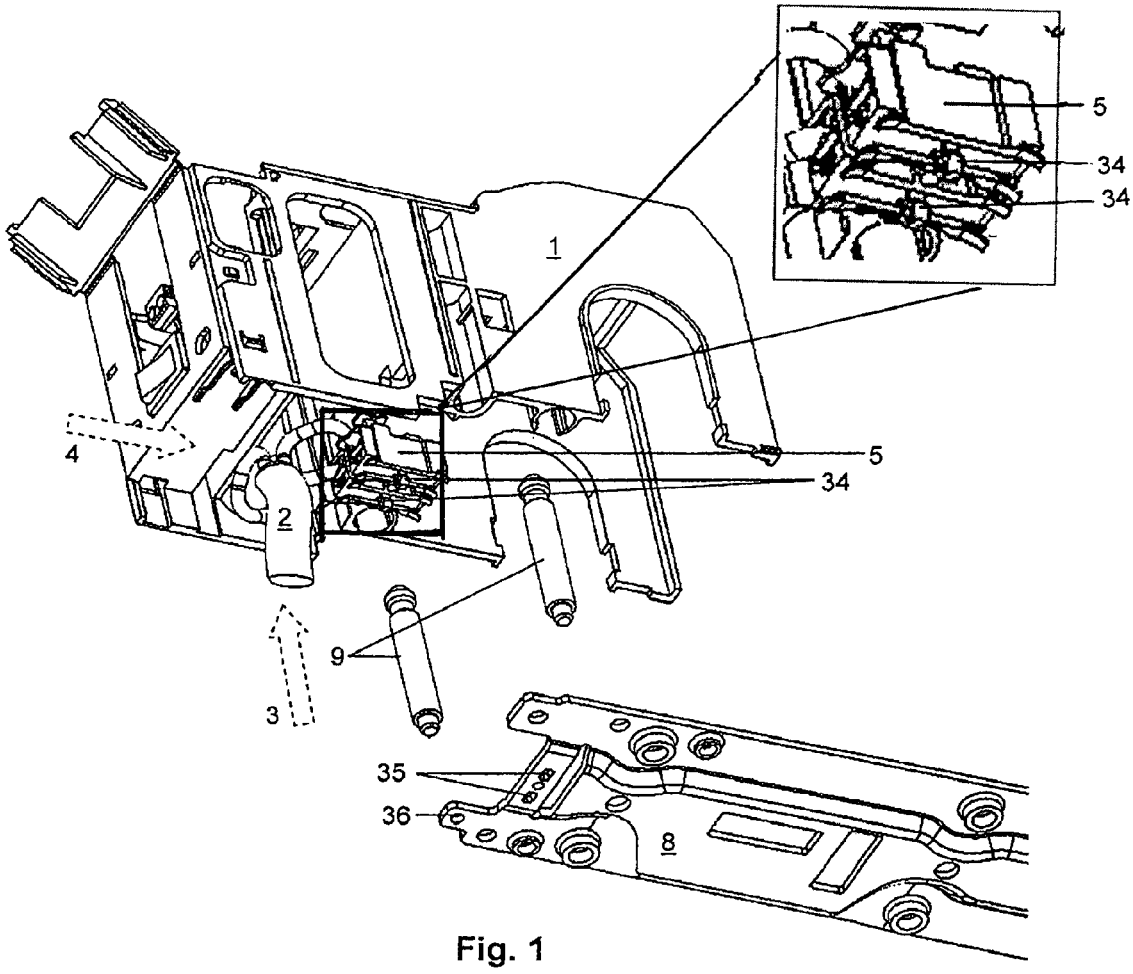
FIG. 1 is an embodiment of the connector module in a perspective view, wherein the installation position of the connector module is revealed by the shown mounting plate.

FIG. 1 is an embodiment of the inventive connector module 1 from an underside direction. It is from this underside direction that the connector module 1 is connectable to the mounting plate 8 via pilot pins 9. A terminal connector component 5 for establishing an electrical connection of the connecting line 2 is received within the connector module 1. According to the invention, the connecting line 2 may be guided to the connector module 1 either from the direction of a reception body, illustrated by an arrow 3, or from a lateral direction 4. By way of example the connecting line 2 is illustrated as power supply unit, wherein the connecting line 2 may likewise comprise signal lines to sensors or to a central control. The illustration shows the connecting line 2 arriving from the direction 3 of the reception body. The lateral direction 4, illustrated as a dashed line, represents in this case an alternative guiding direction of the connecting line 2.

The illustrated terminal connector component 5 has latching projections 34 via which the terminal connector component 5 is connected to the mounting plate 8 and is thereby disposed to be at least locked against rotation, in that the latching projections 34 latch in latching recesses 35, which are provided in the mounting plate 8. The mounting plate 8 has furthermore an electrical interconnect point 36 which serves for electrically contacting a grounding contact within the connecting line 2.

In addition or as an alternative, preferably in the shipping condition, the terminal connector component 5 is attached at the mounting plate 8 in a releasable manner, for example by screwing or is permanently attached, for example by riveting.

Figure 2:
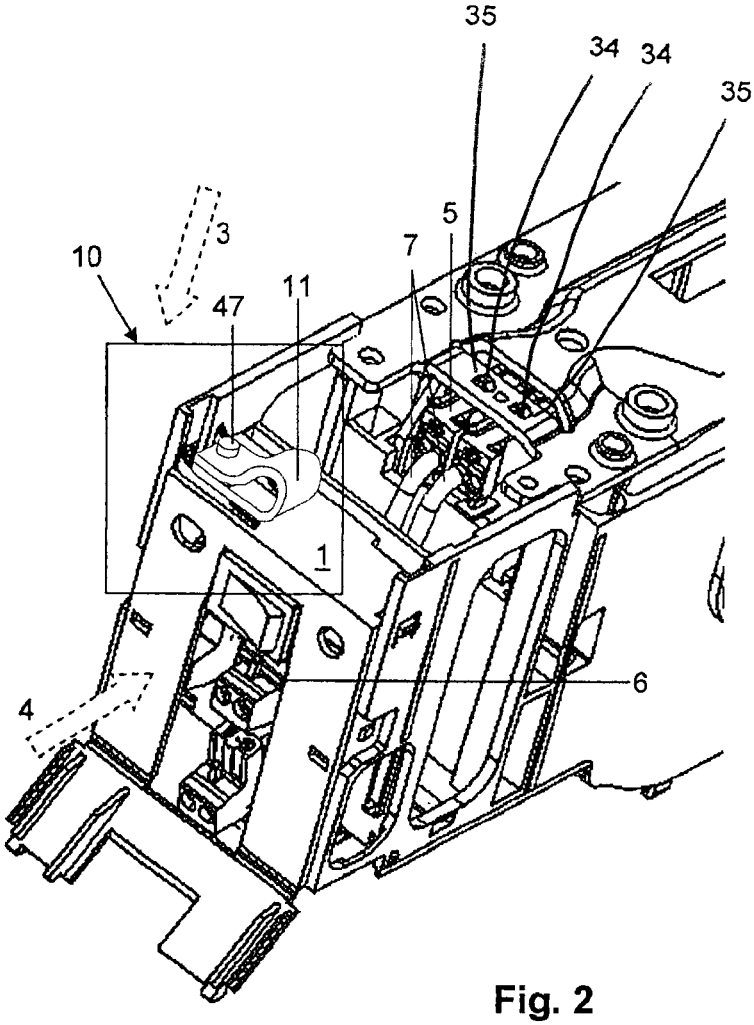
FIG. 2 is another perspective view of the connector module according to FIG. 1.

FIG. 2 is a perspective view of the connector module 1 from an underside direction, wherein both the direction 3 towards the reception body and the lateral direction 4 are indicated. According to this illustration, the connecting line—non-illustrated to simplify—can be guided to the connector module 1 via the lateral direction 4. A cable relief 10 is provided for this purpose, which may serve for the mechanical cable relief of the connecting line and is located at the body of the connector module 1. The cable relief 10 comprises a clamping element 11, which is attached at the connector module 1 by a screw 47, shown by way of example. The connecting line may extend through the clamping element 11, such that a mechanical tensile load in the connecting line is absorbed by the clamping element 11 and not transferred to the terminal connector component 5. A connecting bridge line 7 is provided between the terminal connector component 5 and a distributor circuit board 6 present in the connector module 1, in order to continue the electrical supply, via the external connecting line from the terminal connector component 5, to the distributor circuit board 6.

Figure 2A:
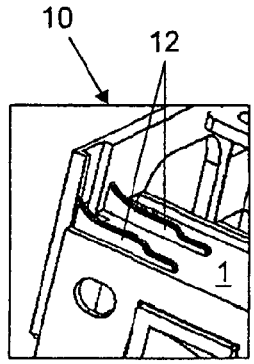
FIG. 2*a* is a detail view of the cable relief element according to FIG. 2.

FIG. 2*a* is a detailed view of the cable relief 10 according to FIG. 2. In this case, the clamping element 11 and the screw 47 are not shown, however it can be seen that a clamping element reception 12 is provided in the body of the connector module 1. The clamping element reception 12 is configured like an insert such that the clamping element 11 can be inserted between two insert strips and screwed in the middle. The mechanical load, which is transferred from the connecting line to the clamping element 11, is redirected to the connector module 1.

Figure 3:
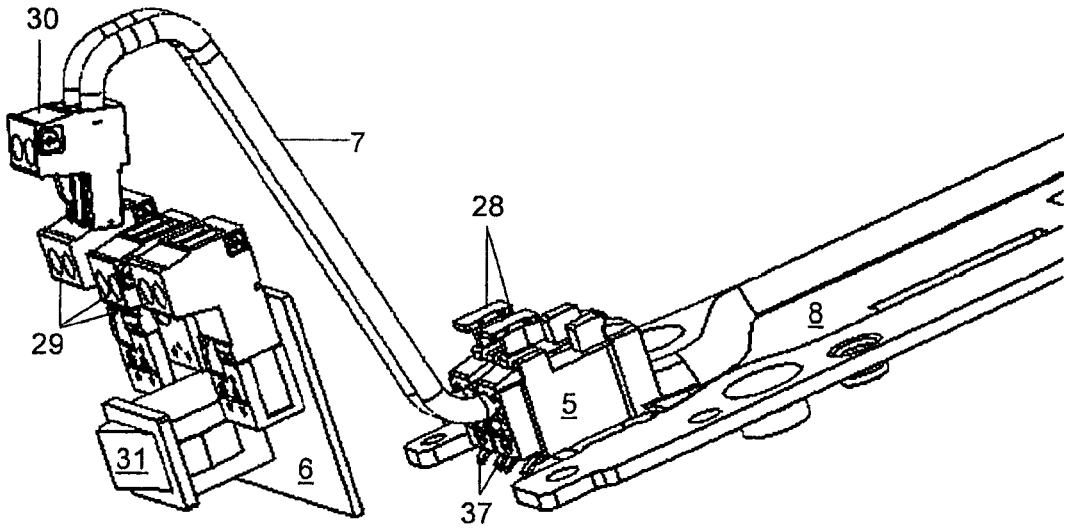
FIG. 3 is a perspective view of a connecting bridge line disposed between the terminal connector component on the mounting plate and the distributor circuit board.

FIG. 3 is an enlarged perspective individual view of the connecting bridge line 7 disposed between the terminal connector component 5 and the distributor circuit board 6. The terminal connector component 5 is shown on the mounting plate 8 in its installed disposition. The connecting bridge line 7 may be manually released from the terminal connector component 5 by unlocking push buttons 28, respectively inserted and retained in the latter. Advantageously, the terminal connector component 5 is configured such as to require operating the unlocking push buttons 28 in order to remove a respective connecting line from the terminal connector component 5. When connecting the connecting bridge line 7, the respective line just needs to be inserted into the terminal connector component 5, the arresting being automatically realized by the terminal connector component 5. At the end side, the connecting bridge line 7 has a connecting plug 30 which can be plugged into a complementarily configured connecting socket 29 on the distributor circuit board 6. By way of example, the connecting sockets 29 are threefold on the distributor circuit board 6, wherein another connecting socket 29 serves for connecting the power supply of a power supply unit within the door operator, whereas the third connecting socket 29 is intended for supplying power to another door operator, which may be a component of a closing sequence controller for example. Furthermore, an ON-OFF switch is located on the distributor circuit board 6 by which the door operator can be switched on and off.

Although not illustrated in FIG. 3 for the sake of clarity, power supply conductors of the connecting line 2 are understood as being plugged into the connecting terminals 37, which are disposed in the terminal connector component 5 preferably next to the respective conductor of the connecting bridge line 7. Thus, as a result of connecting lines 2 and 7 to terminal connector component 5, an electrical coupling exists between the respective associated conductors, disposed next to each other, of the connecting lines 2 and 7.

Figure 4:
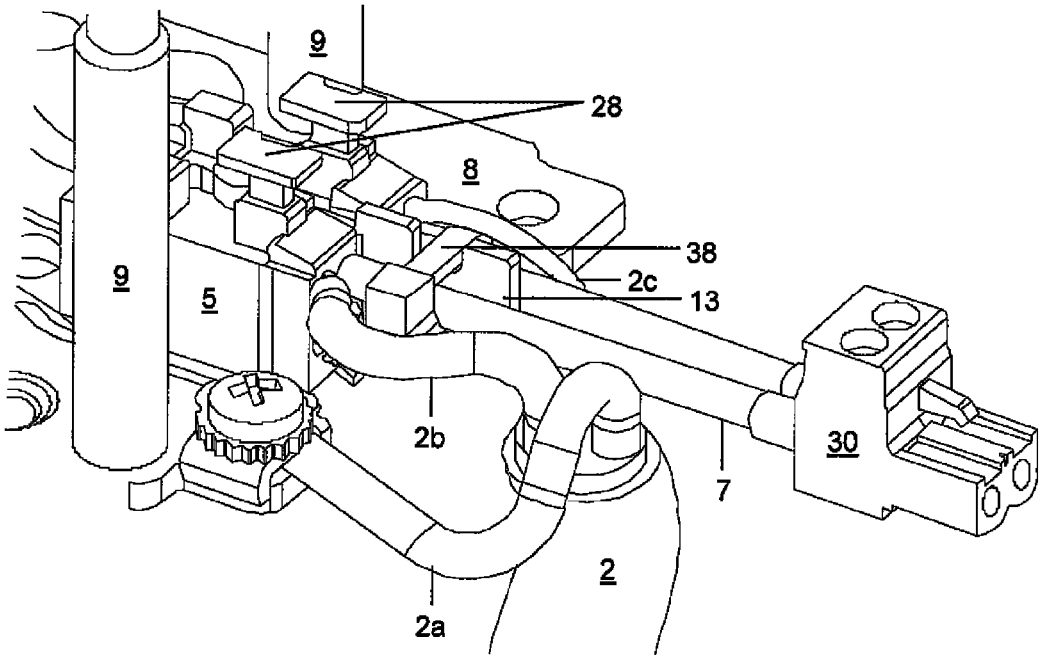
FIG. 4 is a perspective view of the mounting plate, with the terminal connector component, as well as two pilot pins and a cable relief element, which is connected to the terminal connector component.

FIG. 4 shows another perspective view of the terminal connector component 5 disposed on the mounting plate 8 and illustrated with pilot pins 9 mounted thereon. Furthermore, the unlocking push buttons 28 are again illustrated in the terminal connector component 5 such that, when manually operating the unlocking push buttons 28, the connecting bridge line 7 and/or the connecting line 2 can be removed from the terminal connector component 5. Furthermore, in order to provide a mechanical cable relief between the connecting bridge line 7 and the terminal connector component 5, a cable relief element 13 is shown, which is positively inserted into the terminal connector component 5. The connecting bridge line 7 is tied to the cable relief element 13 via the shown cable tie 38, shown by way of example, such as to divert, with the connecting plug 30, a mechanical tensile load of the connecting bridge line 7 into the cable relief element 13. Possible embodiments of the cable relief element 13 are illustrated in more detail in FIG. 5.

FIG. 4 is the connection of a neutral conductor, grounding line 2*a* of the connecting line 2, to the mounting plate 8. Preferably, just the two other conductors 2*b*, 2*c*, configured as phase conductors, of the connecting line 2 configured by way of example as a 230V cable, are connected to the terminal connector component 5.

As shown in FIG. 4, the edges of the cable relief element 13 can be slanted or rounded.

Figure 5A:
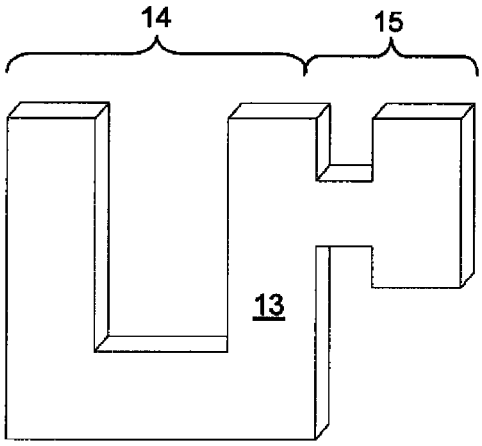
FIGS. 5*a* and 5*b* are perspective views of a first and a second embodiment of the cable relief element.
Figure 5B:
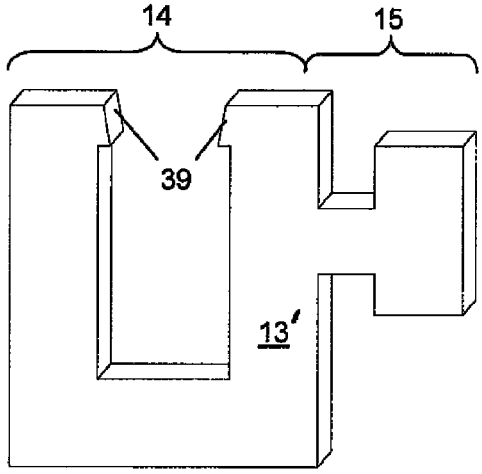

FIG. 5 shows a first and a second embodiment of the cable relief element 13, 13'. The cable relief element 13, 13' has a U-shaped section 14, for a positive insert into the terminal connector component 5, as well as a T- or H-shaped section is for a clamping connection to the connecting bridge line 7 and/or the connecting line 2, for example by a cable tie 38. The cable relief element 13 is integrally configured and can be manufactured as a stamped component from sheet metal. In order to prevent potential electrical short circuits, for example between the conductors of the connecting bridge line 7, the cable relief element 13 is preferably made from plastic material. The terminal connector component 5, like a European-style terminal strip, may have a central web which separates the two poles of the connecting line, or of the connecting bridge line 7, from each other. The central web may be surrounded, preferably in a clamping manner, by the U-shaped section 14. The T-shaped or H-shaped section 15 has two indentations, into which the cable tie 38 is inserted. In order to provide for a better latching of the cable relief element 13 in the terminal connector component 5, latching noses 39 reaching into the U-shaped section 14 may be provided such that the clamping action can be foregone, or the holding force resulting therefrom can be increased or supported.

Figure 6:
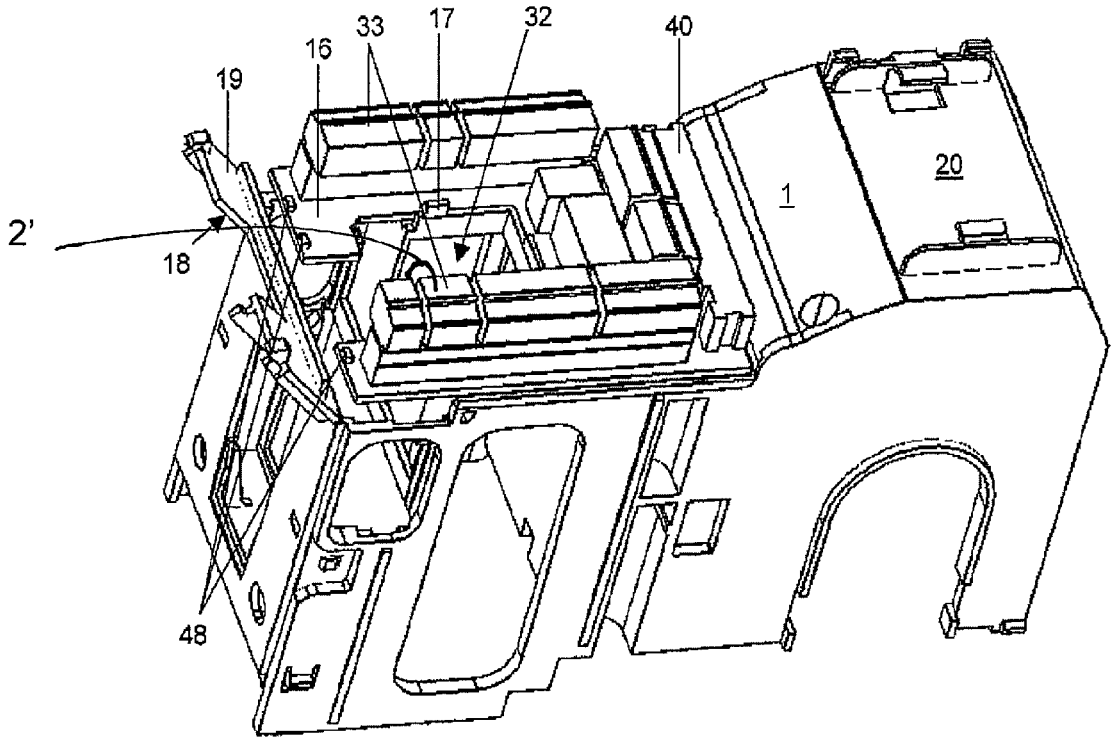
FIG. 6 is a perspective view of the connector module from the top side of the door operator, with the signal connecting circuit board being disposed.

FIG. 6 is the connector module 1 in a perspective view from the top side direction. A signal connecting circuit board 16 is affixed on the top side on the basket-shaped configured connector module 1, wherein the board can be latched on the connector module 1 via latching element 17. The signal connecting circuit board 16 is preferably U-shaped or horseshoe-shaped and, on its topside, it has several connecting terminals 33. An opening 32, corresponding to the U-shaped recess within the signal connecting circuit board 16, is located on the topside in the connector module 1, through which opening the signal lines, for example connecting line 2', can be guided to the connecting terminals 33.

The connector module 1 has furthermore a support part 19, which forms a partial area 18 for the support of the signal connecting circuit board 16 on the connector module 1 and is illustrated only by way of example in a folded-down form. When mounting the connector module 1 and when establishing the electrical connections, in particular of the power supply, the support part 19 may remain in the opened position to allow for access to the inside of the connector module 1. Once the internal connections are established, and once the distributor circuit board is inserted into the connector module 1, the support part 19 will be folded-up such that the partial area 18 thereof becomes a part of a whole support surface of the signal connecting circuit board 16. As a consequence, during following work on the signal connections via the connecting terminals 33, the high-voltage carrying components are concealed within the connector module 1 by the support part 19. The connector module 1 has furthermore a cable guide 20, which is configured as a support surface and serves for guiding a flat cable which extends between a flat cable connector 40, in the shape of a plug or a socket, and a control unit provided in the door operator, wherein the flat cable is not illustrated in detail in the illustration.

The signal connecting circuit board 16 is preferably configured with visual indicators 48, for example in the shape of LED and/or LCD displays, which display by way of example the operating and/or malfunctioning conditions of the door operator, an upcoming service or the like. With the enclosure in place, the visual indicators 48 are preferably visible from the outside.

Figure 7:
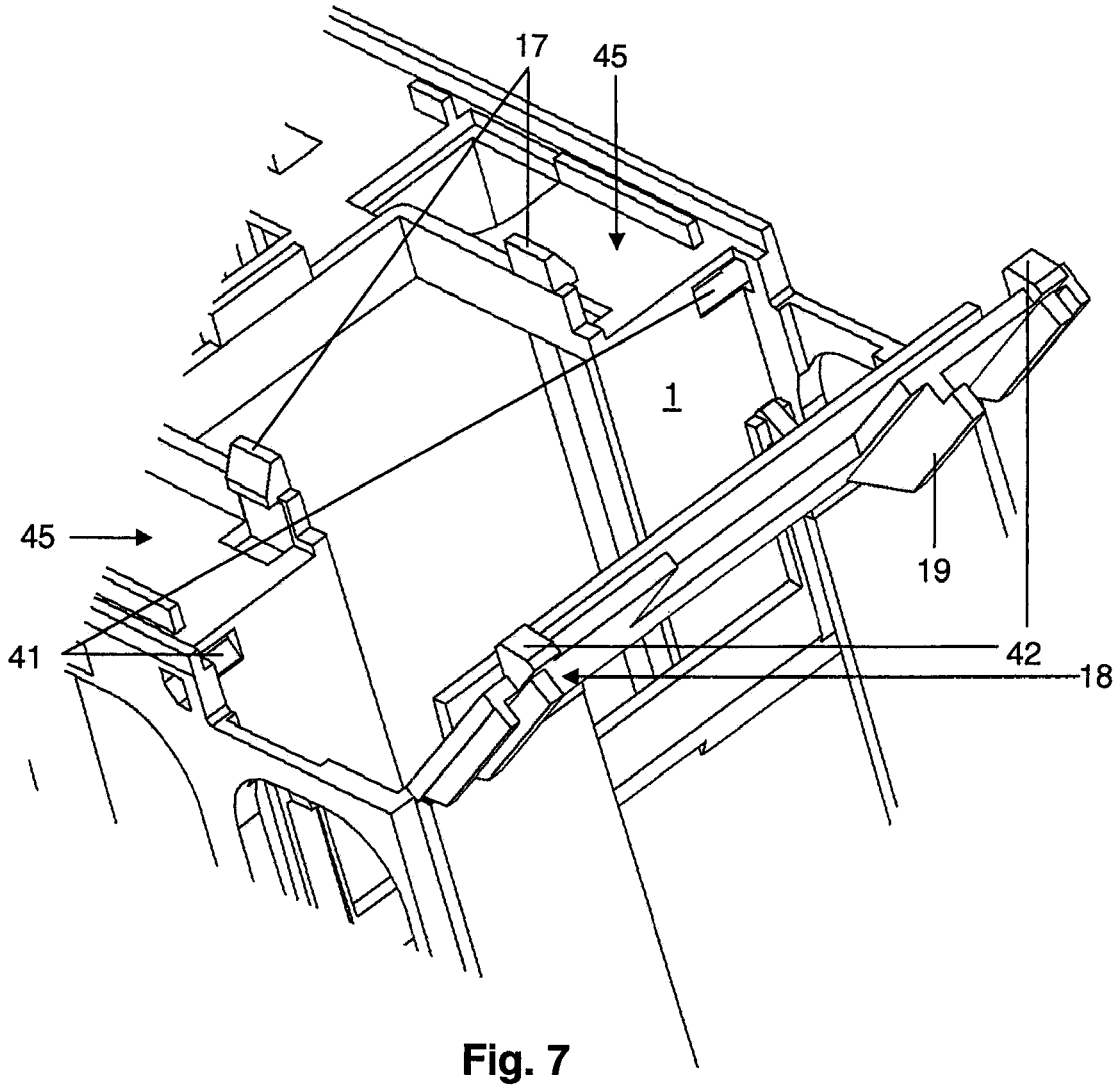
FIG. 7 is a top side view of the connector module according to FIG. 6, without the signal connecting circuit board.

FIG. 7 is a perspective view of the top side of the connector module 1, wherein it is revealed that the connector module 1 is basket-shaped or shell-shaped configured and manufactured for example in an injection moulding process or a metal die-casting process. All components are clipped on and to the connector module 1 or are inserted or latched via mechanical joining connections. The support part 19 is preferably integrally connected to the connector module 1 via a film hinge. It is furthermore revealed that the partial area 18, with the support part 19 being folded-up, together with the support surface 45, provided laterally at the latching element 17, forms the entire support surface for the signal connecting circuit board 16, which is not illustrated in FIG. 7. If the support part 19 is folded-up, in order to latch on the body of the connector module 1, the latter has latching recesses 41, into which the latching noses 42 can latch, which are conformed to the support part 19.

Figure 8A:
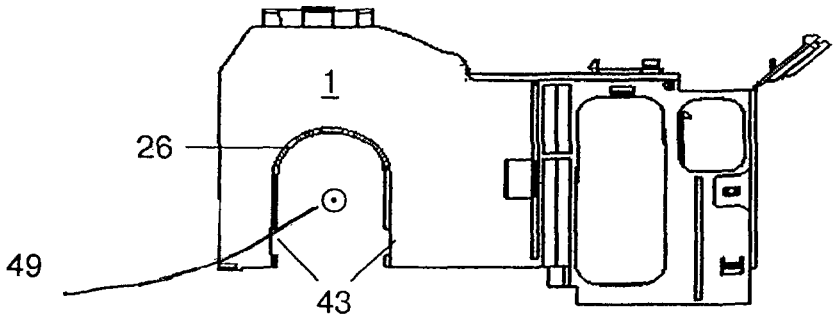
FIGS. 8*a*, 8*c* and 8*d*, comprise lateral views of the door operator and first and a second closure elements, which are optionally insertable into pocket-like recesses provided in the connector module.

FIG. 8*a* is a lateral view of the connector module 1 with a pocket-shaped recess 26. The pocket-shaped recess 26 is located in a body section of the connector module 1, which section may protrude beyond a drive unit 21 present in the door operator; however not illustrated in FIG. 8*a*. A door operator output shaft can be led out of the drive unit 21, which shaft needs to break through the walling of the connector module 1. Very often door operators have drive units from which the door operator output shaft may optionally exit at a first side and/or a second side of the door operator. As a consequence there is the need to provide a closure element 27*a* and/or 27*b*, shown in FIGS. 8*c* and 8*d*, respectively, which either allows for the shaft passage or represents a blind plug, in order to close the pocket-shaped recess 26. Consequently the closure element 27*a* has a contour, which, when inserted into the pocket-shaped recess 26, forms preferably a circular hole within the walling of the connector module 1. If the door operator output shaft is not led out of the shown side of the connector module 1, the closure element 27*b* is inserted into the pocket-shaped recess 26 without the shaft passage and is latched therein via latching recesses 43.

If the output shaft exits on both sides of the drive unit 21, a closure element 27*a* is preferably mounted at the side of the connector module 1, at which the door leaf is connected for example via an arm assembly. At the opposite side of the connector module 1, preferably a closure element 27*b* is accordingly fitted on, which covers the shaft passage in the connector module 1.

By removing the closure element 27, the output shaft is accessible, without having to take off an entire covering plate, which is more complicated.

In case of a so-called tandem-solution, in which two door operators are operatively coupled to each other, closure elements 27*a* are mounted to the door operator, at which both the door leaf and the other door operator are directly connected.

Figure 8B:
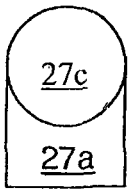
FIG. 8*b* is a modification of the first and second closure element of FIGS. 8*c* and 8*d*.
Figure 8C:
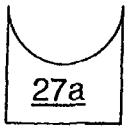
Figure 8D:
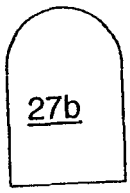

FIG. 8*b* shows another variant of closure elements, in which closure element 27*a* is configured similarly to the closure element 27*a* of FIG. 8*c*, but closure element 27*b* is replaced with closure element 27*c*. However, if covering the output shaft of door operator 1, two covering parts are utilized in this embodiment, on the one hand, the closure element 27*a* and, on the other hand, closure element 27*c*, which is configured in cross-section preferably circular such that, together with the closure element 27*a*, it results in an output shaft covering which is formed similarly to the closure element 27*b* in FIG. 8*d*. In this case, the closure elements 27*a*, 27*c* may be configured such that, prior to being placed onto the connector module 1, they are fitted together to form substantially one complete covering part. As an alternative, the closure elements 27*c* and 27*a* are placed one after the other onto the connector module 1. As shown in FIG. 8*b*, the closure elements 27*a*, 27*c* preferably form an output shaft covering with a shape similar to the closure element 27*b* in FIG. 8*d*.

To form a respective output shaft covering, the closure elements 27*a*, 27*b* are placed onto the connector module 1 in the direction 49, namely in the direction of the plane of the page in FIG. 8*a*.

The closure element 27*b* is preferably configured according to the ones described above and placed onto the output shaft of the door operator 1 itself. In this case, only fastening elements for the closure element 27*a* need to be provided.

Advantageously, with the closure element 27*a* in place, the closure element 27*b* can be removed from the connector module 1, for example can be pried off. This is advantageous in that the closure element 27*b*, with the door operator 1 installed and equipped with the enclosure, can be uninstalled at any time, in order to expose or to cover the respective end of the output shaft of the door operator 1. Thereby a mechanic does not have to pay attention beforehand which closure element 27*a*, 27*b* he has to place or to remove at what location, prior to installing the door operator 1, which makes the installation more mounting-friendly.

This embodiment has the advantage of being able to utilize more shared components and of being able to choose simpler shapes for specific parts, namely the closure element 27*b*, and thus of requiring less material.

In both embodiments, the first closure element 27*a* exposes the respective end of the output shaft of the door operator 1, and thus creates a shaft passage for the output shaft. The second closure element 27*b* in turn covers the output shaft to the outside.

Figure 9A:
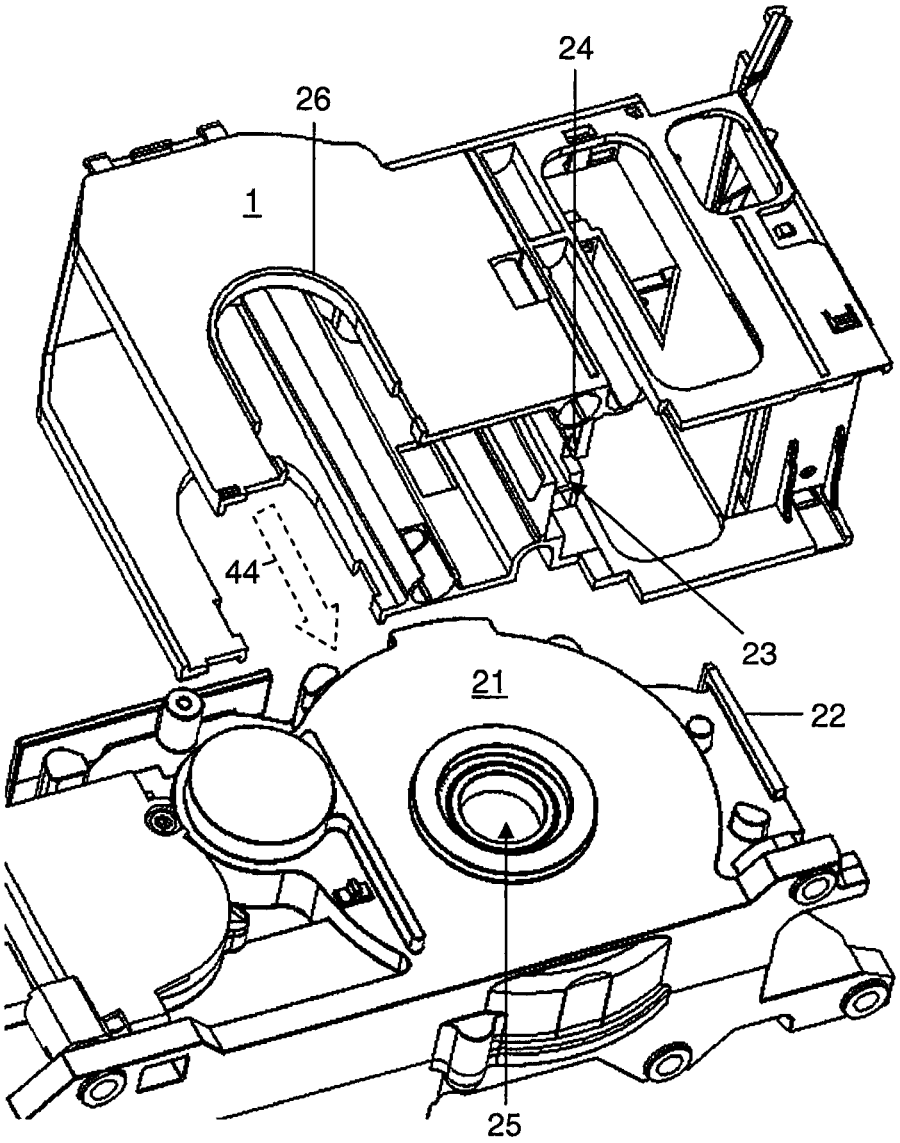
FIGS. 9*a* and 9*b* are two perspective views of the connector module and the drive unit, as well as of the guiding element and latching device.
Figure 9B:
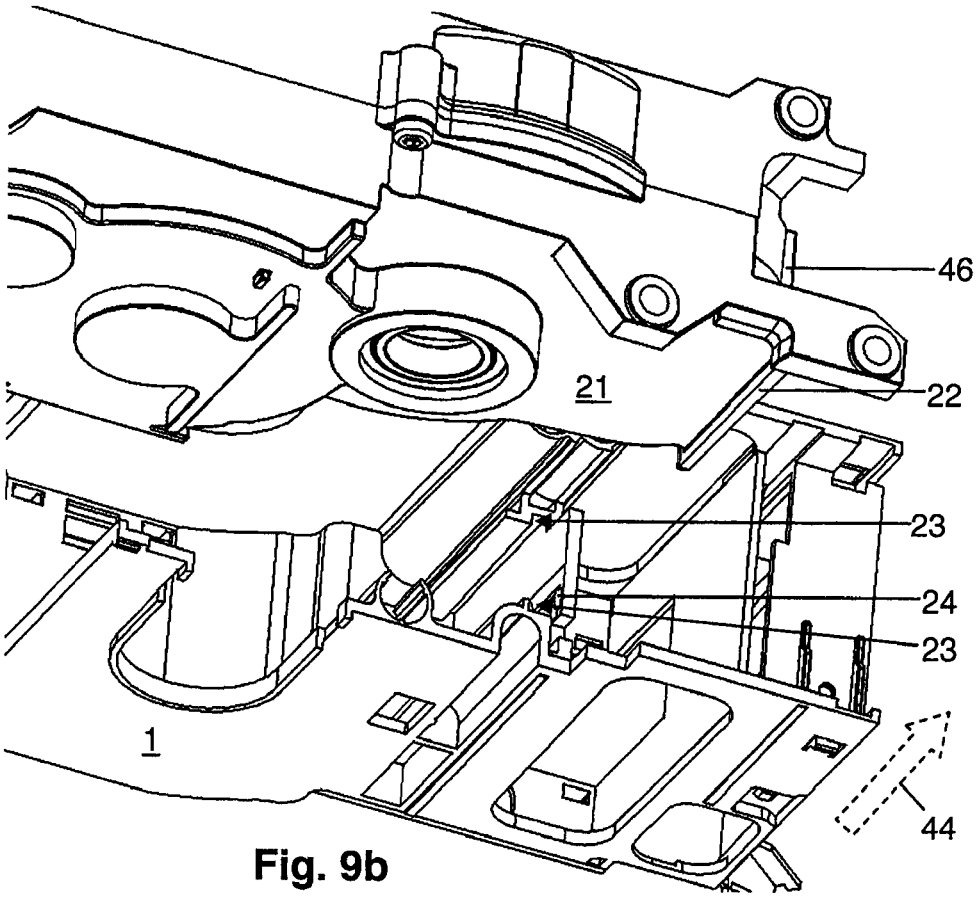

FIGS. 9*a* and 9*b* finally show the disposition of the connector module in relation to the drive unit 21 of the door operator in two perspective views. Slip-on projections 22, which can be slipped into slip-on recesses 23 within the connector module 1, are provided at the drive unit 21. In this case, the disposition of the slip-on projections 22 corresponds to the slip-on recesses 23, such that the connector module 1 can be pushed onto the drive unit 21, preferably in a clamping manner, from a joining direction illustrated by the arrow 44. In order to preferably latch the connector module 1 onto the drive unit 21, latching elements are provided which are configured as latching projections 24. The one latching projection 24, shown by way of example, latches behind a latching surface 46, configured at the drive unit 21, thus in the installed condition engages the surface from behind. If the connector module 1 is latched on the drive unit 21, both components 1 and 21 form a single item to be manipulated by the mechanic. Furthermore, the shaft passage 25 for guiding the non-illustrated door operator output shaft to the outside is illustrated in the drive unit 21, which shaft can extend through the pocket-shaped recess 26, located within the connector module 1, and can protrude from the latter and serves to mechanically connect the swing leaf of the door system via an appropriate arm assembly.

The invention in its configuration is not limited to the above presented preferred embodiment. On the contrary, a number of variants are conceivable, which make use of the presented solution, likewise with basically different types of executions. All features and/or advantages including the constructional details, spatial dispositions and process steps, which result from the claims, the description or the drawings, may be essential to the invention, both by themselves and in their most various combinations. In particular the individual components of the connector module 1, as well as related structural components are latched onto the connector module 1. No connecting elements are required to establish the individual connections. The latching relates in particular to the distributor circuit board 6, the signal connecting circuit board 16, as well as to the closure elements 27*a* and 27*b*, which can be installed at the connector module 1 essentially without requiring any additional tools. Furthermore, the latching technique is applied to the connector module 1 which latches onto any other component of the door operator, for example the drive unit 21.

Instead of or in addition to the described latching connections, other retaining mechanisms, such as clamping, screwing or the like are possible.

The described connecting sockets and connecting plugs may be replaced for example by continuous lines or cables.

The above described slip-on recesses 23 and slip-on projections 24 may be configured such that the drive unit 21 has the slip-on recesses 23 and the connector module the slip-on projections 24.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A door operator configured to operate a swing leaf of a door assembly and to be mounted to a reception body, comprising:

a connector module for connecting at least one connecting line, the connector module comprising:

a signal connecting circuit board defining a U-shaped circuit board opening communicating with a top side opening of the connector module, the connecting line extending through the top side opening and said U-shaped circuit board opening into the connector module, the circuit board carrying a connecting terminal to which the connecting line is connected, and at least one slip-on recess; and a drive unit to which the connector module is mechanically and self-retainingly connected with at least one slip-on projection inserted into the slip-on recess.

2. The door operator according to claim 1, wherein at least one terminal connector component is arranged in the connector module and configured to establish an electrical connection with another connecting line.

3. The door operator according to claim 2, further comprising a mounting plate, wherein the at least one terminal connector component is fastened to the mounting plate.

4. The door operator according to claim 2, further comprising:

at least one distributor circuit board arranged in the connector module and configured for distributing power, provided through the another connecting line, from at least one power supply; and a connecting bridge line that extends from the terminal connector component to the distributor circuit board to establish an electrical connection therebetween.

5. The door operator according to claim 4, further comprising:

a cable relief element disposed on the connector module and configured to mechanically receive the connecting bridge line; and at least one clamping element configured to retain the connecting bridge line.

6. The door operator according to claim 5, wherein the cable relief element is adjacent the terminal connector component.

7. The door operator according to claim 6, wherein the cable relief element further comprises one of a T-shaped section and an H-shaped section.

8. The door operator according to claim 6, wherein the cable relief element has a U-shaped section.

9. The door operator according to claim 5, wherein a second clamping element is inserted into a clamping element receiver of the connector module.

10. The door operator according to claim 2, further comprising: a plurality of pilot pins; and a mounting plate, wherein the door operator is mounted to the reception body by the mounting plate and the connector module is positioned on the mounting plate by the plural pilot pins.

11. The door operator according to claim 10, wherein the connector module protrudes beyond the mounting plate.

12. The door operator according to claim 1, wherein the signal connecting circuit board is attached to the connector module by at least one latching element.

13. The door operator according to claim 12, wherein the connector module comprises a support area for supporting the signal connecting circuit board, wherein a portion of the support area is adjacent a support part that is hingedly attached to the connector module.

14. The door operator according to claim 12, wherein the signal connecting circuit board comprises visual indicators.

15. The door operator according to claim 12, wherein the signal connecting circuit board is adapted to be coupled to a flat cable which is guided over the connector module by at least one flat cable guiding element.

16. The door operator according to claim 1, wherein the connector module is self-retainingly connected to the drive unit by a latching element that comprises at least one latching projection.

17. The door operator according to claim 1, wherein the drive unit comprises a shaft passage for receiving a door operator output shaft, wherein the connector module protrudes beyond the shaft passage and has a recess through which the door operator output shaft passes.

18. The door operator according to claim 17, further comprising at least one of a first closure element configured to be inserted into the recess and to thereby form a passage in the connector module for the door operator output shaft, and a second closure element configured to be inserted into the recess and thereby cover the shaft passage.

* * * * *